US009301608B2

(12) United States Patent
Lee et al.

(10) Patent No.: US 9,301,608 B2
(45) Date of Patent: Apr. 5, 2016

(54) STORAGE HAVING PAIR OF DRAWERS DRAWN IN OPPOSITE DIRECTIONS

(71) Applicant: SAMSUNG ELECTRONICS CO., LTD., Suwon-si, Gyeonggi-do (KR)

(72) Inventors: Yang Jic Lee, Gwacheon-si (KR); Sang Chul Lee, Namyangju-si (KR); Yeong Sook Chae, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/331,446

(22) Filed: Jul. 15, 2014

(65) Prior Publication Data

US 2015/0022067 A1 Jan. 22, 2015

(30) Foreign Application Priority Data

Jul. 16, 2013 (KR) ..... 10-2013-0083485

(51) Int. Cl.

| | |
|---|---|
| ***A47B 67/04*** | (2006.01) |
| ***A47B 88/02*** | (2006.01) |
| ***A47B 71/00*** | (2006.01) |
| ***A47B 67/00*** | (2006.01) |
| ***A47B 88/04*** | (2006.01) |

(52) U.S. Cl.

CPC ..... *A47B 88/02* (2013.01); *A47B 67/00* (2013.01); *A47B 71/00* (2013.01); *A47B 88/04* (2013.01); *A47B 2088/023* (2013.01); *A47B 2088/026* (2013.01); *A47B 2088/0403* (2013.01)

(58) Field of Classification Search

CPC ..... A47B 67/00; A47B 67/04; A47B 71/00; A47B 88/02; A47B 88/04; A47B 88/0014; A47B 2088/0403

USPC ..... 312/330.1, 348.1, 348.2, 402, 404, 283, 312/286; 62/382

See application file for complete search history.

(56) References Cited

U.S. PATENT DOCUMENTS

| | | | | |
|---|---|---|---|---|
| 1,453,121 | A * | 4/1923 | Benner | 312/286 |
| 1,653,530 | A * | 12/1927 | Abrachinsky | 312/286 |
| 2,171,772 | A * | 9/1939 | Viehmann | 312/286 |

(Continued)

FOREIGN PATENT DOCUMENTS

| | | |
|---|---|---|
| DE | 2 054 400 | 6/1972 |
| FR | 2 679 116 | 1/1993 |
| JP | 2004-81758 | 3/2004 |
| JP | 2004-188110 | 7/2004 |
| KR | 2019940017435 | 7/1994 |
| KR | 2019960027756 | 8/1996 |

(Continued)

OTHER PUBLICATIONS

Extended European Search Report dated Oct. 12, 2014 in corresponding European Application No. 14169552.8.

*Primary Examiner* — James O Hansen
(74) *Attorney, Agent, or Firm* — Staas & Halsey LLP

(57) ABSTRACT

A storage including a main body with a storeroom. The storeroom having a first opening and a second opening opposite to the first opening. The storeroom also having a first drawer that is drawn through the first opening and a second drawer drawn through the second opening. The storeroom further having a storage basket provided between the first drawer and the second drawer, where the storeroom restricts one of the first and second drawers from being drawn in a state in which the other is drawn. When the first drawer is drawn, the storage basket is drawn through the first opening together with the first drawer, and when the second drawer is drawn, the storage basket is drawn through the second opening together with the second drawer.

26 Claims, 9 Drawing Sheets

(56) References Cited

U.S. PATENT DOCUMENTS

| | | | | | |
|---|---|---|---|---|---|
| 2,404,851 | A | * | 7/1946 | Knowles et al. | 312/286 |
| 2,716,046 | A | * | 8/1955 | Minturn | 312/286 |
| 4,002,385 | A | * | 1/1977 | Hone | 312/286 |
| 4,178,049 | A | * | 12/1979 | Loo | 312/286 |
| 5,682,936 | A | * | 11/1997 | Higdon, Jr. | 144/345 |

FOREIGN PATENT DOCUMENTS

| | | |
|---|---|---|
| KR | 1998-014152 | 6/1998 |
| KR | 1020010040423 | 7/2001 |
| KR | 2003-0004764 | 1/2003 |
| KR | 1020090097898 | 10/2009 |
| KR | 10-2011-0040572 | 4/2011 |

* cited by examiner

STORAGE HAVING PAIR OF DRAWERS DRAWN IN OPPOSITE DIRECTIONS

CROSS-REFERENCE TO RELATED APPLICATIONS

This application claims the benefit of Korean Patent Application No. 10-2013-0083485, filed on Jul. 16, 2013 in the Korean Intellectual Property Office, the disclosure of which is incorporated herein by reference.

BACKGROUND

1. Field

Embodiments of the present disclosure relate to a storage having a pair of drawers drawn in opposite directions.

2. Description of the Related Art

An island type storage is a storage which is not disposed at a wall in contact but is disposed in an open space like an island. At the top of the island type storage is provided a table on which food is placed such that users may eat or cook the food. At the lower part of the island type storage is provided a storeroom to store food. In the storeroom may be provided a drawer which is slidably drawn.

In the conventional island type storage, however, the drawer is drawn only in one direction. For this reason, it may be necessary for a user to move in a direction in which the drawer is drawn when the user stores food in the drawer or takes the food from the drawer. In a case in which a plurality of users eats or cooks food at opposite sides of the island type storage, the user at one side of the island type storage may easily access the drawer but the user at the other side of the island type storage may not access the drawer.

On the other hand, a pair of drawers may be provided in the storeroom such that the drawers are drawn in opposite directions. However, there is no great difference between this structure and a structure having one drawer if the respective drawers have independent storage spaces.

SUMMARY

It is an aspect of the present disclosure to provide a storage having a pair of drawers drawn in opposite directions, wherein the drawers jointly use a storage basket.

Additional aspects of the disclosure will be set forth in part in the description which follows and, in part, will be obvious from the description, or may be learned by practice of the disclosure.

In accordance with an aspect of the present disclosure, a storage includes a main body, a storeroom provided in the main body, the storeroom having a first opening and a second opening opposite to the first opening, a first drawer provided in the storeroom such that the first drawer is drawn through the first opening, a second drawer provided in the storeroom such that the second drawer is drawn through the second opening, and a storage basket provided between the first drawer and the second drawer, wherein drawing of one of the first and second drawers is restricted in a state in which the other is drawn, when the first drawer is drawn, the storage basket is drawn through the first opening together with the first drawer, and, when the second drawer is drawn, the storage basket is drawn through the second opening together with the second drawer.

The first drawer may include a first connection member rotatably provided between a connection position at which the first drawer is connected to the storage basket and a disconnection position at which the first drawer is disconnected from the storage basket.

The first connection member may include a pushed part pushed by the main body and an insertion part bent from the pushed part such that the insertion part is inserted into the storage basket.

The storage basket may include a first connection groove, into which the first connection member is inserted at the connection position.

The storage basket may include a front wall, a rear wall, opposite sidewalls, and a bottom and the first connection groove may be formed at the bottom of the storage basket.

The main body may include a first receiving groove, in which the first connection member is received at the disconnection position.

The main body may include a first push part to push the first connection member such that the first connection member is rotated from the disconnection position to the connection position when the first drawer is drawn.

The first drawer may be opened at a rear thereof such that the storage basket passes through the open rear of the first drawer.

The first drawer may include a bottom to support the storage basket, the bottom of the first drawer may include a convex part protruding toward the second drawer and a concave part depressed from the convex part toward the first drawer, and the first connection member may be provided at an end of the convex part.

The storage may further include a first rail unit provided at opposite sides of the first drawer to slidably support the first drawer and a second rail unit provided at opposite sides of the second drawer to slidably support the second drawer, wherein the first rail unit and the second rail unit may be provided at different heights such that the first rail unit and the second rail unit do not interfere with each other.

The second drawer may include a second connection member rotatably provided between a connection position at which the second drawer is connected to the storage basket and a disconnection position at which the second drawer is disconnected from the storage basket.

The second connection member may include a pushed part pushed by the main body and an insertion part bent from the pushed part such that the insertion part is inserted into the storage basket.

The storage basket may include a second connection groove, into which the second connection member is inserted at the connection position.

The storage basket may include a front wall, a rear wall, opposite sidewalls, and a bottom and the second connection groove may be formed at the bottom of the storage basket.

The main body may include a second receiving groove, in which the second connection member is received at the disconnection position.

The main body may include a second push part to push the second connection member such that the second connection member is rotated from the disconnection position to the connection position when the second drawer is drawn.

The second drawer may be opened at a rear thereof such that the storage basket passes through the open rear of the second drawer.

The second drawer may include a bottom to support the storage basket, the bottom of the second drawer may include a convex part protruding toward the first drawer and a concave part depressed from the convex part toward the second drawer, and the second connection member may be provided at an end of the convex part.

In accordance with another aspect of the present disclosure, a storage includes a main body, a storeroom provided in the main body, the storeroom having a first opening and a second opening opposite to the first opening, a first drawer provided in the storeroom such that the first drawer is drawn through the first opening, a second drawer provided in the storeroom such that the second drawer is drawn through the second opening, a storage basket provided between the first drawer and the second drawer, a first connection member rotatably provided at the first drawer to connect the first drawer to the storage basket or to disconnect the first drawer from the storage basket, and a second connection member rotatably provided at the second drawer to connect the second drawer to the storage basket or to disconnect the second drawer from the storage basket.

When the first drawer is drawn, the first drawer may be connected to the storage basket by the first connection member such that the storage basket is drawn through the first opening together with the first drawer, and, when the second drawer is drawn, the second drawer may be connected to the storage basket by the second connection member such that the storage basket is drawn through the second opening together with the second drawer.

When the first drawer is drawn, movement of the second connection member may be restrained such that drawing of the second drawer is restricted, and, when the second drawer is drawn, movement of the first connection member may be restrained such that drawing of the first drawer is restricted.

The first drawer and the second drawer may be opened at rears thereof such that the storage basket passes through the open rears of the first drawer and the second drawer.

The first drawer and the second drawer may each include a bottom to support the storage basket, the bottom of the first drawer and the bottom of the second drawer may each include a convex part and a concave part, and the bottom of the first drawer and the bottom of the second drawer may engage with each other such that the convex part of the bottom of the first drawer is inserted into the concave part of the bottom of the second drawer and the convex part of the bottom of the second drawer is inserted into the concave part of the bottom of the first drawer.

The storage may further include a first rail unit provided at opposite sides of the first drawer to slidably support the first drawer and a second rail unit provided at opposite sides of the second drawer to slidably support the second drawer, wherein the first rail unit and the second rail unit may be provided at different heights such that the first rail unit and the second rail unit do not interfere with each other.

In accordance with another aspect of the present disclosure, a storage includes a main body, a storeroom provided in the main body, the storeroom having a first opening and a second opening opposite to the first opening, a first drawer provided in the storeroom such that the first drawer is drawn through the first opening, a second drawer provided in the storeroom such that the second drawer is drawn through the second opening, a first rail unit to slidably support the first drawer, and a second rail unit to slidably support the second drawer, wherein the first rail unit and the second rail unit are provided at different heights.

In accordance with a further aspect of the present disclosure, a storage includes a main body, a storeroom provided in the main body, the storeroom having a first opening and a second opening opposite to the first opening, a first drawer provided in the storeroom such that the first drawer is drawn through the first opening, and a second drawer provided in the storeroom such that the second drawer is drawn through the second opening, wherein the first drawer and the second drawer each include a bottom to support the storage basket, the bottom of the first drawer and the bottom of the second drawer each include a convex part and a concave part, and the bottom of the first drawer and the bottom of the second drawer engage with each other such that the convex part of the bottom of the first drawer is inserted into the concave part of the bottom of the second drawer and the convex part of the bottom of the second drawer is inserted into the concave part of the bottom of the first drawer.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
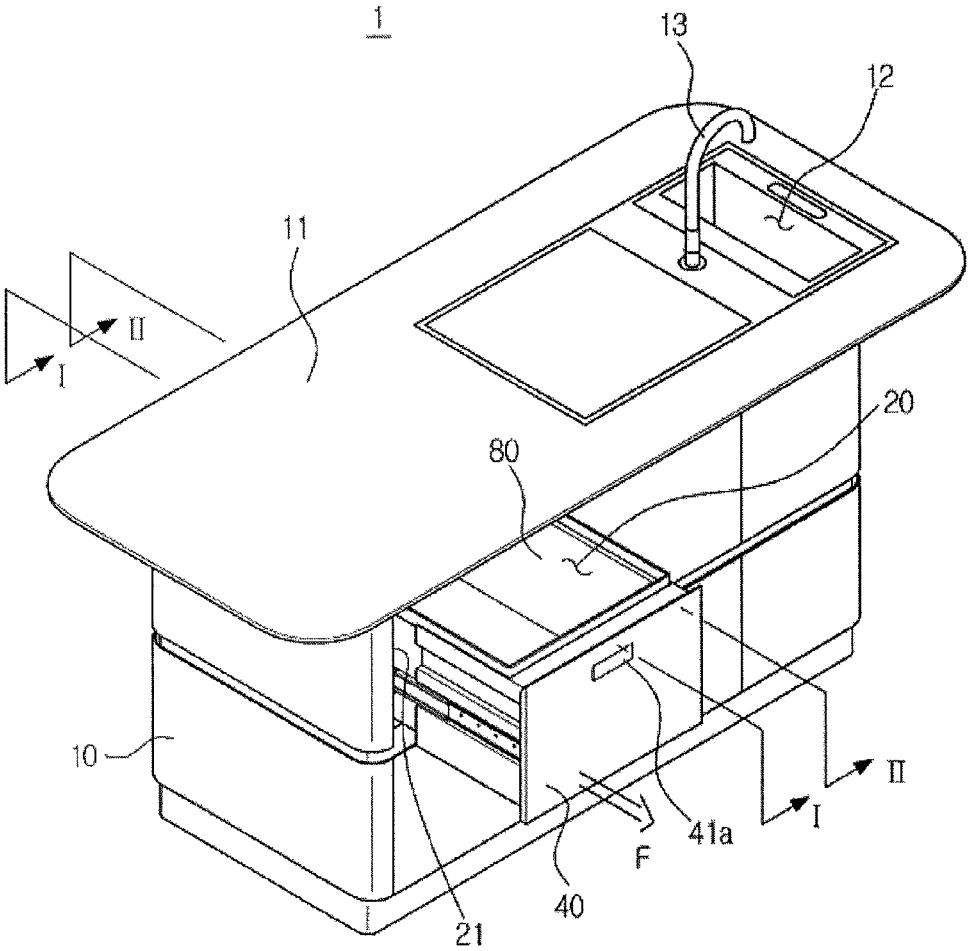
FIG. 1 is a view showing the external appearance of a storage according to an embodiment of the present disclosure.

Reference will now be made in detail to the embodiments of the present disclosure, examples of which are illustrated in the accompanying drawings, wherein like reference numerals refer to like elements throughout.

Figure 2:
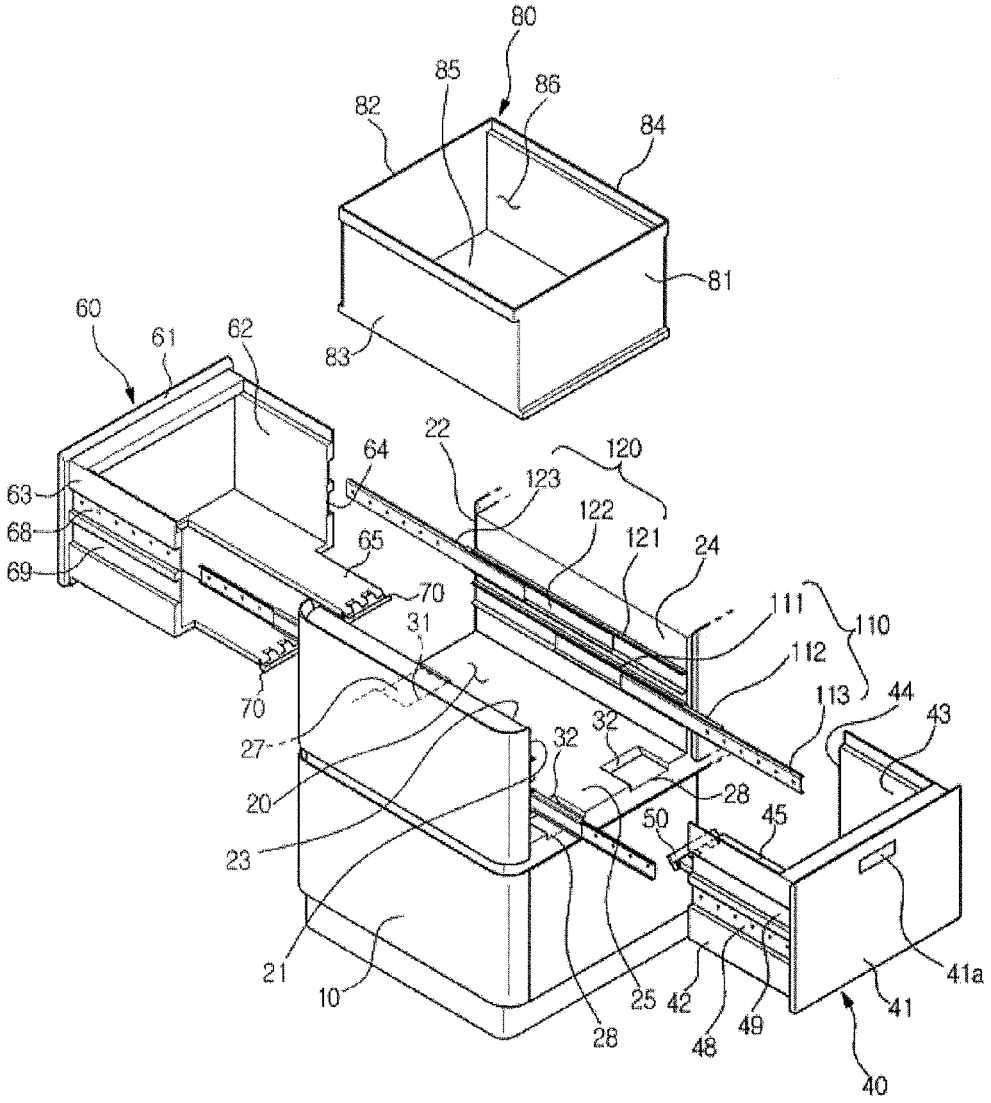
FIG. 2 is an exploded view showing a pair of drawers and a storage basket disposed in a storeroom of the storage of FIG. 1.
Figure 3:
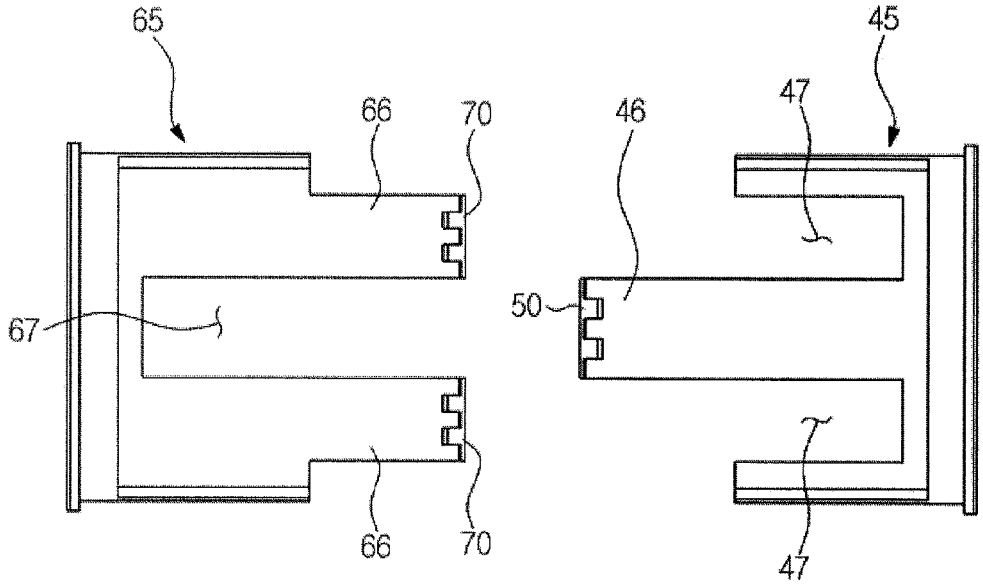
FIG. 3 is a plan view showing bottoms of the drawers of the storage of FIG. 1.

FIG. 1 is a view showing the external appearance of a storage according to an embodiment of the present disclosure. FIG. 2 is an exploded view showing a pair of drawers and a storage basket disposed in a storeroom of the storage of FIG. 1. FIG. 3 is a plan view showing bottoms of the drawers of the storage of FIG. 1.

Referring to FIGS. 1 to 3, a storage 1 according to an embodiment of the present disclosure is a so-called island type storage which is not disposed at a wall in contact but is disposed in an open space like an island such that two or more users may cook and eat food and wash the dishes while facing each other and having a storeroom 20 to store food.

The storage 1 may include a main body 10 having the storeroom 20 to store food, a top plate 11 disposed at the top of the main body 10 such that food is placed on the top plate 11, a sink 12 in which food and tableware may be washed and cleaned using water, and a tap 13 connected to an external water supply source to supply water to the sink 12.

The storage 1 may further include a cool water supply device to supply cool water to the storeroom 20 and an insulation structure to insulate the storeroom 20 to store food in a frozen state. For example, an evaporator 14 (see FIG. 4) to generate cool air may be disposed above the storeroom 20. The cool air generated by the evaporator 14 may be supplied to the storeroom 20 through cool air through holes 15. Alternatively, the evaporator 14 may be disposed at a wall of the storeroom 20 in contact to directly cool the storeroom 20.

Of course, a compressor (not shown), a condenser (not shown), and an expansion valve (not shown), which constitute a refrigeration cycle together with the evaporator 14, may be appropriately disposed at the main body 10.

The storeroom 20 may be provided in the main body 10 approximately in the shape of a box. The storeroom 20 has a first opening 21 (see FIG. 2) and a second opening 22 (see FIG. 2) opened toward a front side F and a rear side R of the storage 1 such that the storeroom 20 may be accessed through the first opening 21 and the second opening 22.

In the storeroom 20 is provided a pair of slidable drawers 40 and 60. The drawers 40 and 60 include a first drawer 40 drawn toward the front of the storage 1 through the first opening 21 of the storeroom 20 and a second drawer 60 drawn toward the rear of the storage 1 through the second opening 22 of the storeroom 20.

At the first drawer 40 may be provided a grip 41*a*, which a user may hold to draw the first drawer 40. In the same manner, a grip (not shown) may be provided at the second drawer 60.

Between the first drawer 40 and the second drawer 60 may be provided a storage basket 80 to store food. The storage basket 80 may be interlocked with the first drawer 40 such that the storage basket 80 may be drawn through the first opening 21 when the first drawer 40 is drawn. The storage basket 80 may also be interlocked with the second drawer 60 such that the storage basket 80 may be drawn through the second opening 22 when the second drawer 60 is drawn. Consequently, the storage basket 80 may be jointly used on the front side F and the rear side R of the storage 1.

When one of the first and second drawers 40 and 60 is even slightly drawn from the storeroom 20, the other drawer is not drawn.

Hereinafter, details of the first drawer 40, the second drawer 60, and the storage basket 80 and connection structures therebetween will be described in detail.

As clearly shown in FIG. 2, the first drawer 40 has approximately a box shape, the rear of which is open. That is, the first drawer 40 includes a door 41 to open and close the first opening 21 of the storeroom 20, a bottom 45 to support the storage basket 80, opposite sidewalls 42 and 43 vertically extending from opposite sides of the bottom 45 to define a receiving space to receive the storage basket 80, and a rear opening 44, through which the storage basket 80 passes. The grip 41*a* may be provided at the door 41.

On the other hand, the second drawer 60 has approximately a box shape, the rear of which is open. That is, the second drawer 60 includes a door 61 to open and close the second opening 22 of the storeroom 20, a bottom 65 to support the storage basket 80, opposite sidewalls 62 and 63 vertically extending from opposite sides of the bottom 65 to define a receiving space to receive the storage basket 80, and a rear opening 64, through which the storage basket 80 passes. The grip (not shown) may be provided at the door 61.

The first drawer 40 and the second drawer 60 are approximately symmetric. As will hereinafter be described, however, the bottoms 45 and 65 may not be symmetric but engage with each other.

The sidewalls 42 and 43 of the first drawer 40 and the sidewalls 62 and 63 of the second drawer 60 may have a length equivalent to half the total length of the storeroom 20 in the forward and backward direction. Each of the sidewalls 42 and 43 of the first drawer 40 and the sidewalls 62 and 63 of the second drawer 60 may be any length provided that in a state in which both the first drawer 40 and the second drawer 60 are closed, the sidewalls 42 and 43 of the first drawer 40 and the sidewalls 62 and 63 of the second drawer 60 may not interfere with each other.

On the other hand, the bottom 45 of the first drawer 40 and the bottom 65 of the second drawer 60 may engage with each other.

That is, as clearly shown in FIG. 3, the bottom 45 of the first drawer 40 may include a convex part 46 protruding toward the second drawer 60 and concave parts 47 depressed from the convex part 46 toward the first drawer 40 and the bottom 65 of the second drawer 60 may include convex parts 66 protruding toward the first drawer 40 and a concave part 67 depressed from the convex parts 66 toward the second drawer 60.

When the first drawer 40 and the second drawer 60 are closed, the convex part 46 of the first drawer 40 may be inserted into the concave part 67 of the second drawer 60 and the convex parts 66 of the second drawer 60 may be inserted into the concave parts 47 of the first drawer 40.

Consequently, the first drawer 40 and the second drawer 60 may be provided in the storeroom 20 approximately at the same height such that the first drawer 40 and the second drawer 60 may be drawn in opposite directions without interference.

Meanwhile, the storage 1 may further include a first rail unit 110 and a second rail unit 120 to slidably support the first drawer 40 and the second drawer 60, respectively.

As shown in FIG. 2, the first rail unit 110 and the second rail unit 120 may be provided at opposite sides of the first drawer 40 and the second drawer 60, respectively.

The first rail unit 110 and the second rail unit 120 each may be a three-step rail type unit to increase a draw distance. That is, the first rail unit 110 may include a main rail 111 fixed to sidewalls 23 and 24 of the storeroom 20, a middle rail 112 slidably coupled to the main rail 111, and a drawer rail 113 fixed to the sidewalls 42 and 43 of the first drawer 40 while being slidably coupled to the middle rail 112.

In the same manner, the second rail unit 120 may include a main rail 121 fixed to the sidewalls 23 and 24 of the storeroom 20, a middle rail 122 slidably coupled to the main rail 121, and a drawer rail 123 fixed to the sidewalls 62 and 63 of the second drawer 60 while being slidably coupled to the middle rail 122.

Meanwhile, although the sidewalls 42 and 43 of the first drawer 40 and the sidewalls 62 and 63 of the second drawer 60 have a length equivalent to half the length of the storeroom 20 in the forward and backward direction, the first drawer 40 and the second drawer 60 may be sufficiently drawn such that most of a storage space 86 of the storage basket 80 is opened.

That is, the first drawer 40 and the second drawer 60 may be drawn by approximately the entire length of the storeroom 20 in the forward and backward direction, not half the length of the storeroom 20.

To this end, the main rail 111 of the first rail unit 110 may extend from the front end to the rear end of the sidewalls 23 and 24 of the storeroom 20 and the main rail 121 of the second rail unit 120 may extend from the front end to the rear end of the sidewalls 23 and 24 of the storeroom 20.

Meanwhile, although the first drawer 40 and the second drawer 60 may be provided at approximately the same height, the first rail unit 110 and the second rail unit 120 may be provided at different heights as shown in FIG. 2.

This is because, since the first drawer 40 and the second drawer 60 are drawn by approximately the entire length of the storeroom 20 in the forward and backward direction as previously described, the first rail unit 110 and the second rail unit 120 may interfere or collide with each other if the first rail unit 110 and the second rail unit 120 are provided at the same height.

At the outsides of the sidewalls 42 and 43 of the first drawer 40 may be provided a first rail receiving groove 48, in which the first rail unit 110 is received, and a third rail receiving groove 49, in which the second rail unit 120 is received. Since the first rail unit 110 and the second rail unit 120 are provided at different heights, the first rail receiving groove 48, in which the first rail unit 110 is received, and the third rail receiving groove 49, in which the second rail unit 120 is received, are also provided at different heights.

At the outsides of the sidewalls 62 and 63 of the second drawer 60 may be provided a second rail receiving groove 68, in which the second rail unit 120 is received, and a fourth rail receiving groove 69, in which the first rail unit 110 is received. Since the first rail unit 110 and the second rail unit 120 are provided at different heights, the second rail receiving groove 68, in which the second rail unit 120 is received, and the fourth rail receiving groove 69, in which the first rail unit 110 is received, are also provided at different heights.

Meanwhile, the first drawer 40 and the second drawer 60 are respectively provided with a first connection member 50 and second connection members 70 to connect the respective drawers and the storage basket 80 such that the storage basket 80 is drawn simultaneously when the respective drawers are drawn.

The storage basket 80 is provided between the first drawer 40 and the second drawer 60 to store food. The storage basket 80 has approximately a box shape, the top of which is open. The storage basket 80 may include a front wall 81, a rear wall 82, opposite sidewalls 83 and 84, a bottom 85, and a storage space 86.

The first connection member 50 and the second connection members 70 are rotatably coupled to the bottom 46 of the first drawer 40 and the bottom 66 of the second drawer 60, respectively.

Specifically, the first connection member 50 is rotatably coupled to the end of the convex part 46 of the bottom 45 of the first drawer 40 and the second connection members 70 are rotatably coupled to the ends of the convex parts 66 of the bottom 65 of the second drawer 60.

At the bottom 85 of the storage basket 80 are provided a first connection groove 91 (see FIG. 4) and second connection grooves 92 (see FIG. 8) corresponding to the first connection member 50 and the second connection members 70, respectively. In addition, a first receiving groove 27 and a first push part 31 and second receiving grooves 28 and second push parts 32 are provided at a bottom 25 of the storeroom 20.

Hereinafter, a structure in which the respective drawers 40 and 60 are interlocked with the storage basket 80 by the first connection member 50 and the second connection members 70 and a structure in which one of the drawers is prevented from being drawn when the other drawer is drawn will be described in detail.

Figure 4:
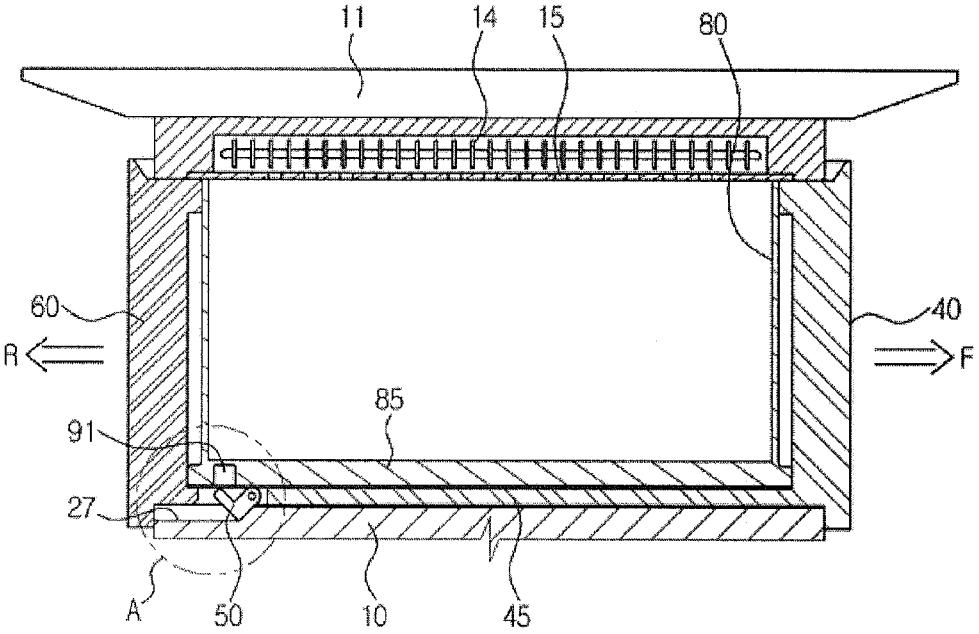
FIG. 4 is a sectional view illustrating a connection structure between a first drawer and the storage basket of the storage of FIG. 1.
Figure 5:
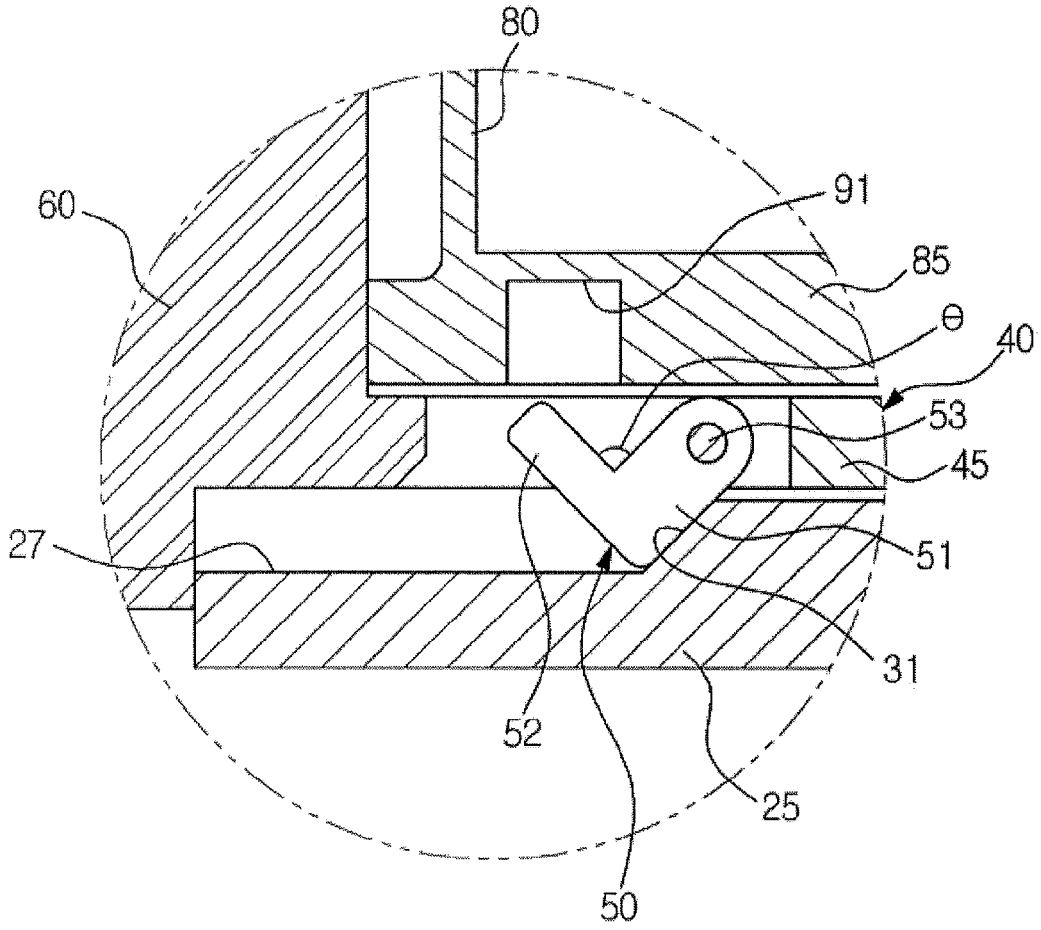
FIG. 5 is an enlarged view showing part A of FIG. 4.
Figure 6:
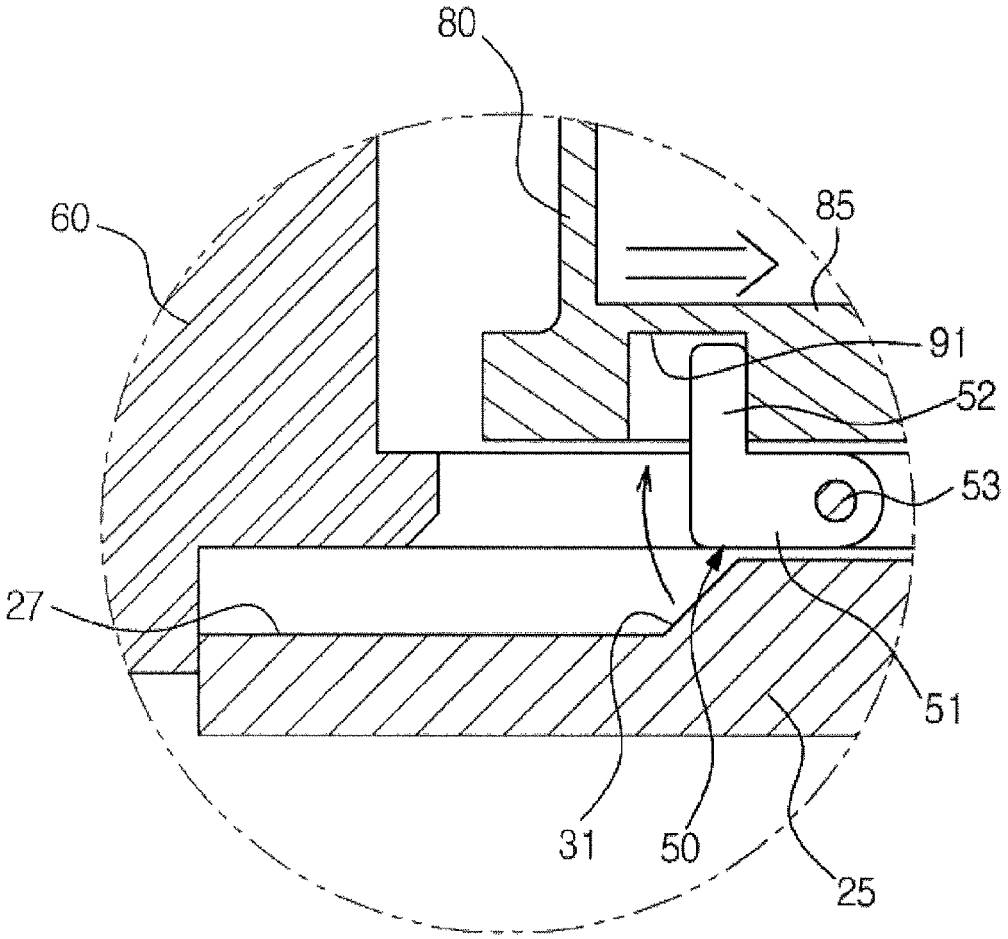
FIG. 6 is an enlarged view showing part A of FIG. 4 when the first drawer is drawn.
Figure 7:
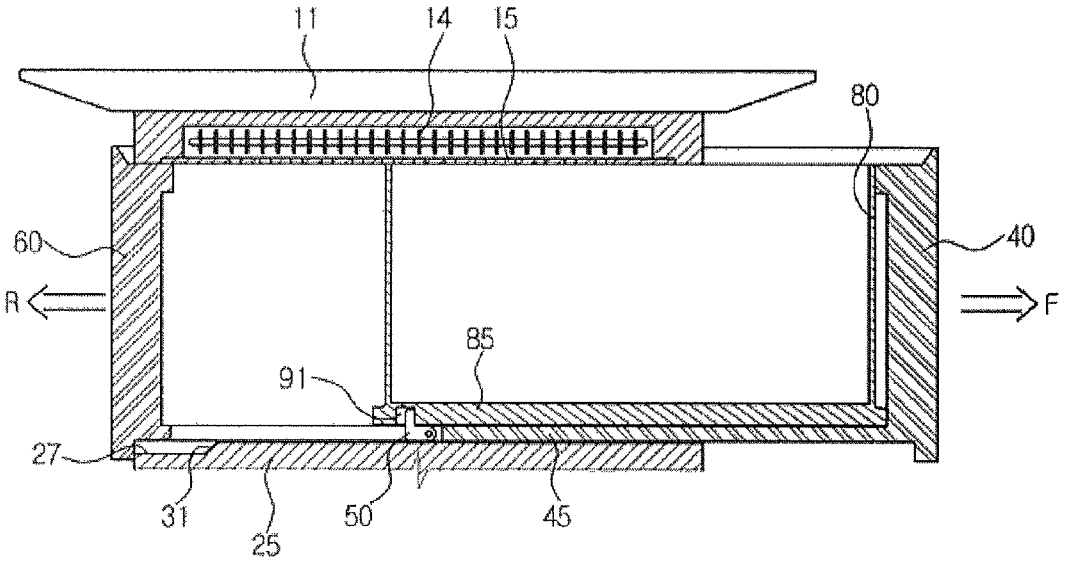
FIG. 7 is a sectional view taken along line I-I of FIG. 1 showing the connection structure between the first drawer and the storage basket when the first drawer is drawn.
Figure 8:
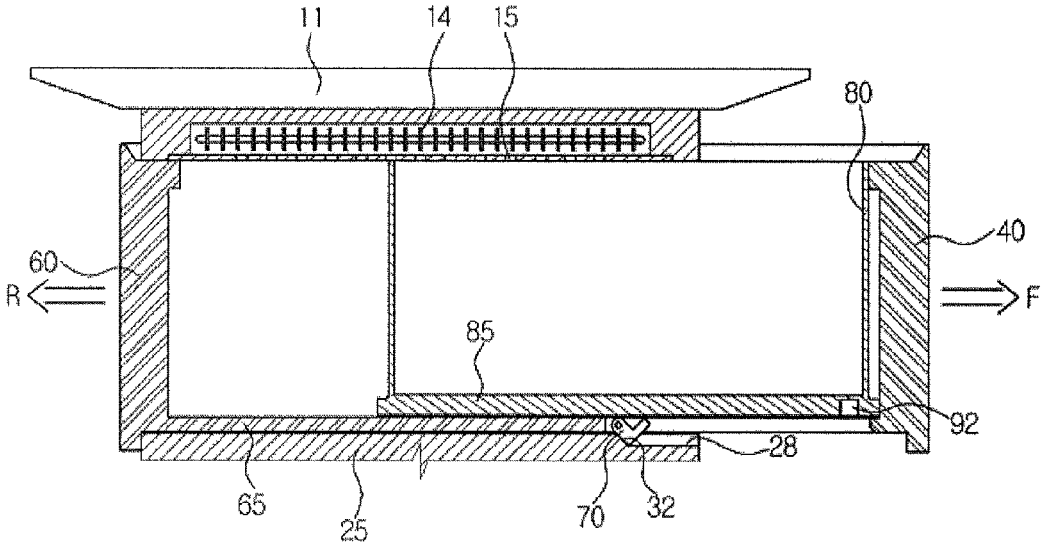
FIG. 8 is a sectional view taken along line II-II of FIG. 1 illustrating a structure to lock drawing of a second drawer in a state in which the first drawer is drawn.
Figure 9:
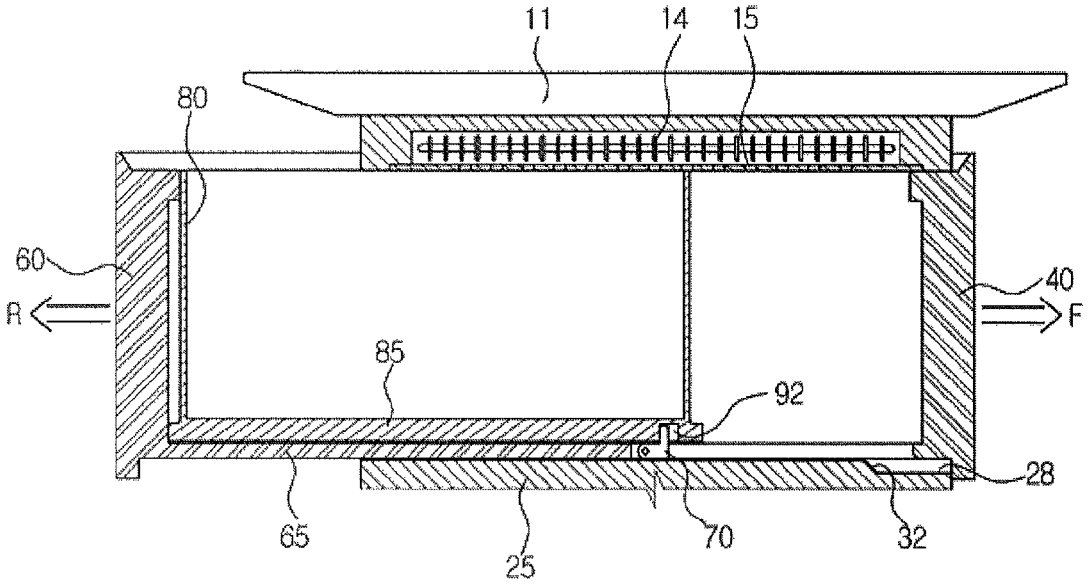
FIG. 9 is a view showing a connection structure between the second drawer and the storage basket when the second drawer of the storage of FIG. 1 is drawn.

FIG. 4 is a sectional view illustrating a connection structure between the first drawer and the storage basket of the storage of FIG. 1. FIG. 5 is an enlarged view showing part A of FIG. 4. FIG. 6 is an enlarged view showing part A of FIG. 4 when the first drawer is drawn. FIG. 7 is a sectional view taken along line I-I of FIG. 1 showing the connection structure between the first drawer and the storage basket when the first drawer is drawn. FIG. 8 is a sectional view taken along line II-II of FIG. 1 illustrating a structure to lock drawing of the second drawer in a state in which the first drawer is drawn. FIG. 9 is a view showing a connection structure between the second drawer and the storage basket when the second drawer of the storage of FIG. 1 is drawn.

The first connection member 50 and the second connection members 70 are symmetric in construction. Hereinafter, therefore, the first connection member 50 will mainly be described and a description of the second connection members 70 will be omitted.

As clearly shown in FIGS. 5 and 6, the first connection member 50 is rotatably coupled to the bottom 45 of the first drawer 40. The first connection member 50 may be rotated about a hinge shaft 53.

The first connection member 50 may be rotated between a disconnection position at which the first drawer 40 is disconnected from the storage basket 80 as shown in FIG. 5 and a connection position at which the first drawer 40 is connected to the storage basket 80 as shown in FIG. 6.

When the first connection member 50 is located at the disconnection position, the first connection member 50 may not be interfered with by the storage basket 80. When the first connection member 50 is located at the connection position, the storage basket 80 may move simultaneously when the first drawer 40 is moved.

The first connection member 50 may have approximately a clamp shape. That is, the first connection member 50 may include a pushed part 51 connected to the hinge shaft 53 of the first connection member 50 and an insertion part 52 bent from the pushed part 51. Consequently, a predetermined angle θ is provided between the pushed part 51 and the insertion part 52. The angle θ may be, but is not limited to, 90 degrees.

The pushed part 51 is pushed by the first push part 31 of the storeroom 20 when the first drawer 40 is drawn. As the pushed part 51 is pushed by the first push part 31, the first connection member 50 may be rotated clockwise about the hinge shaft 53.

When the first connection member 50 is rotated, the insertion part 52 is inserted into the first connection groove 91 of the storage basket 80 to connect the first drawer 40 to the storage basket 80 and to transfer movement force of the first drawer 40 to the storage basket 80.

When the first drawer 40 is fully inserted into the storeroom 20, the first connection member 50 is received in the first receiving groove 27 of the storeroom 20. Consequently, the first connection member 50 received in the first receiving groove 27 may not be interfered with by the storage basket 80.

When the first drawer 40 is drawn, therefore, the first connection member 50 is rotated from the disconnection position to the connection position to connect the first drawer 40 to the storage basket 80 such that the storage basket 80 is drawn together with the first drawer 40.

Meanwhile, drawing of the second drawer 60 is restricted in a state in which first drawer 40 is drawn. FIG. 8 is a view illustrating a structure in which drawing of the second drawer 60 is restricted by the second connection members 70 in a state in which the first drawer 40 is drawn.

As shown in FIG. 8, the second connection members 70 are received in the second receiving grooves 28 of the storeroom 20 in a state in which the first drawer 40 is drawn. When the second drawer 60 is drawn toward the rear side R in this state, the second connection members 70 are pushed by the second push parts 32 of the storeroom 20 and, therefore, rotational force is applied to the second connection members 70.

Since the storage basket 80 is drawn together with the first drawer 40 toward the front side, however, the second connection grooves 92 provided at the storage basket 80 are moved to positions where the second connection members 70 may not be inserted. As a result, the second connection members 70 are interfered with by the bottom 85 of the storage basket 80 and thus are not rotated. Consequently, the second drawer 60 is not moved and thus is not drawn.

The second drawer 60 may be drawn after the first drawer 40 is fully inserted into the storeroom 20.

As shown in FIG. 9, the storage basket 80 may be drawn together with the second drawer 60. In addition, the first drawer 40 is not drawn by the first connection member 50 in a state in which the second drawer 60 is drawn.

A structure in which the storage basket 80 is drawn simultaneously when the second drawer 60 is drawn and a structure in which drawing of the first drawer 40 is restricted in a state in which the second drawer 60 is drawn are the same as in the first drawer 40.

As is apparent from the above description, according to embodiments of the present disclosure, a storage includes a pair of drawers drawn in forward and backward directions and a storage basket drawn simultaneously when one of the drawers is drawn. Consequently, a user may easily draw the storage basket irrespective of the forward and backward directions to store food in the storage basket or to take food out of the storage basket.

In a case in which two or more users cook food at opposite sides of the storage while facing each other, the users may draw the drawers located in front of themselves to jointly use the storage basket, whereby easily achieving cooperation. For example, when the user at one side of the storage draws the first drawer to store food in the storage basket, the user at the other side of the storage may draw the second drawer to take the food out of the storage basket.

When one of the drawers is drawn, a mechanism to draw the storage basket in an interlocked state is not exposed such that the users may not recognize the interlocking structure.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A storage comprising:

a main body;

a storeroom provided in the main body, the storeroom having a first opening and a second opening opposite to the first opening;

a first drawer provided in the storeroom such that the first drawer is drawn through the first opening;

a second drawer provided in the storeroom such that the second drawer is drawn through the second opening; and a storage basket provided between the first drawer and the second drawer, wherein drawing of one of the first drawer and the second drawer is restricted in a state in which the other is drawn, the first drawer comprises a bottom to support the storage basket, the second drawer comprises a bottom to support the storage basket, when the first drawer is drawn, the storage basket supported by the bottom of the first drawer bottom is drawn through the first opening together with the first drawer, when the second drawer is drawn, the storage basket supported by the bottom of the first drawer bottom is drawn through the second opening together with the second drawer, and the bottom of the first drawer and the bottom of the second drawer are configured to engage with each other.

2. The storage according to claim 1, wherein the first drawer comprises a first connection member rotatably provided between a connection position at which the first drawer is connected to the storage basket and a disconnection position at which the first drawer is disconnected from the storage basket.

3. The storage according to claim 2, wherein the first connection member comprises a pushed part pushed by the main body and an insertion part bent from the pushed part such that the insertion part is inserted into the storage basket.

4. The storage according to claim 2, wherein the storage basket comprises a first connection groove, into which the first connection member is inserted at the connection position.

5. The storage according to claim 4, wherein the storage basket comprises a front wall, a rear wall, opposite sidewalls, and a bottom, and the first connection groove is formed at the bottom of the storage basket.

6. The storage according to claim 2, wherein the main body comprises a first receiving groove, in which the first connection member is received at the disconnection position.

7. The storage according to claim 2, wherein the main body comprises a first push part to push the first connection member such that the first connection member is rotated from the disconnection position to the connection position when the first drawer is drawn.

8. The storage according to claim 2, wherein the bottom of the first drawer comprises a convex part protruding toward the second drawer and a concave part depressed from the convex part toward the first drawer, and the first connection member is provided at an end of the convex part.

9. The storage according to claim 1, wherein the first drawer is opened at a rear thereof such that the storage basket passes through the open rear of the first drawer.

10. The storage according to claim 1, further comprising:

a first rail unit provided at opposite sides of the first drawer to slidably support the first drawer; and a second rail unit provided at opposite sides of the second drawer to slidably support the second drawer, wherein the first rail unit and the second rail unit are provided at different heights such that the first rail unit and the second rail unit do not interfere with each other.

11. The storage according to claim 1, wherein the second drawer comprises a second connection member rotatably provided between a connection position at which the second drawer is connected to the storage basket and a disconnection position at which the second drawer is disconnected from the storage basket.

12. The storage according to claim 11, wherein the second connection member comprises a pushed part pushed by the main body and an insertion part bent from the pushed part such that the insertion part is inserted into the storage basket.

13. The storage according to claim 11, wherein the storage basket comprises a second connection groove, into which the second connection member is inserted at the connection position.

14. The storage according to claim 13, wherein the storage basket comprises a front wall, a rear wall, opposite sidewalls, and a bottom, and the second connection groove is formed at the bottom of the storage basket.

15. The storage according to claim 11, wherein the main body comprises a second receiving groove, in which the second connection member is received at the disconnection position.

16. The storage according to claim 11, wherein the main body comprises a second push part to push the second connection member such that the second connection member is rotated from the disconnection position to the connection position when the second drawer is drawn.

17. The storage according to claim 1, wherein the second drawer is opened at a rear thereof such that the storage basket passes through the open rear of the second drawer.

18. The storage according to claim 17, wherein the bottom of the second drawer comprises a convex part protruding toward the first drawer and a concave part depressed from the convex part toward the second drawer, and the second connection member is provided at an end of the convex part.

19. The storage according to claim 1, further comprising a cool air generating device to supply cool air to the storeroom.

20. A storage comprising:

a main body;

a storeroom provided in the main body, the storeroom having a first opening and a second opening opposite to the first opening;

a first drawer provided in the storeroom such that the first drawer is drawn through the first opening;

a second drawer provided in the storeroom such that the second drawer is drawn through the second opening;

a storage basket provided between the first drawer and the second drawer;

a first connection member rotatably provided at the first drawer to connect the first drawer to the storage basket or to disconnect the first drawer from the storage basket; and a second connection member rotatably provided at the second drawer to connect the second drawer to the storage basket or to disconnect the second drawer from the storage basket wherein the first drawer and the second drawer each comprise a bottom to support the storage basket, and the bottom of the first drawer and the bottom of the second drawer are configured to engage with each other.

21. The storage according to claim 20, wherein when the first drawer is drawn, the first drawer is connected to the storage basket by the first connection member such that the storage basket is drawn through the first opening together with the first drawer, and when the second drawer is drawn, the second drawer is connected to the storage basket by the second connection member such that the storage basket is drawn through the second opening together with the second drawer.

22. The storage according to claim 20, wherein when the first drawer is drawn, movement of the second connection member is restrained such that drawing of the second drawer is restricted, and when the second drawer is drawn, movement of the first connection member is restrained such that drawing of the first drawer is restricted.

23. The storage according to claim 20, wherein the first drawer and the second drawer are opened at rears thereof such that the storage basket passes through the open rears of the first drawer and the second drawer.

24. The storage according to claim 20, wherein the bottom of the first drawer and the bottom of the second drawer each comprise a convex part and a concave part, and the bottom of the first drawer and the bottom of the second drawer engage with each other such that the convex part of the bottom of the first drawer is inserted into the concave part of the bottom of the second drawer and the convex part of the bottom of the second drawer is inserted into the concave part of the bottom of the first drawer.

25. The storage according to claim 20, further comprising:

a first rail unit provided at opposite sides of the first drawer to slidably support the first drawer; and a second rail unit provided at opposite sides of the second drawer to slidably support the second drawer, wherein the first rail unit and the second rail unit are provided at different heights such that the first rail unit and the second rail unit do not interfere with each other.

26. A storage comprising:

a main body;

a storeroom provided in the main body, the storeroom having a first opening and a second opening opposite to the first opening;

a first drawer provided in the storeroom such that the first drawer is drawn through the first opening;

a second drawer provided in the storeroom such that the second drawer is drawn through the second opening; and a storage basket provided between the first drawer and the second drawer, wherein the first drawer and the second drawer each comprise a bottom to support the storage basket, the bottom of the first drawer and the bottom of the second drawer each comprise a convex part and a concave part, and the bottom of the first drawer and the bottom of the second drawer engage with each other such that the convex part of the bottom of the first drawer is inserted into the concave part of the bottom of the second drawer and the convex part of the bottom of the second drawer is inserted into the concave part of the bottom of the first drawer.

* * * * *